US008973473B2

(12) United States Patent
Su

(10) Patent No.: US 8,973,473 B2
(45) Date of Patent: Mar. 10, 2015

(54) INSERT BIT

(75) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 399 days.

(21) Appl. No.: 13/448,768

(22) Filed: Apr. 17, 2012

(65) Prior Publication Data

US 2013/0269492 A1 Oct. 17, 2013

(51) Int. Cl.
*B25B 23/00* (2006.01)
*B25B 15/00* (2006.01)

(52) U.S. Cl.
CPC ..... *B25B 15/005* (2013.01); *B25B 23/0035* (2013.01)
USPC ..... 81/438; 81/177.85

(58) Field of Classification Search
USPC ..... 81/436–438, 177.85, 442, 443, 460, 81/461; 29/507, 512, 522.1, 523; 285/382, 285/382.4, 422, 405; D8/86
See application file for complete search history.

(56) References Cited

U.S. PATENT DOCUMENTS

| | | | | |
|---|---|---|---|---|
| 3,393,722 | A * | 7/1968 | Windham | 81/438 |
| 5,482,312 | A * | 1/1996 | Maurer | 280/728.1 |
| D401,830 | S * | 12/1998 | Schneider | D8/70 |
| 5,868,047 | A * | 2/1999 | Faust et al. | 81/438 |
| 6,745,652 | B2 * | 6/2004 | Chen | 81/438 |
| D615,380 | S * | 5/2010 | Su | D8/86 |
| 8,052,156 | B2 * | 11/2011 | Chen | 279/143 |

* cited by examiner

*Primary Examiner* — Monica Carter
*Assistant Examiner* — Melanie Alexander
(74) *Attorney, Agent, or Firm* — Muncy, Geissler, Olds & Lowe, P.C.

(57) ABSTRACT

An insert bit includes a connecting component and a driving component. The connecting component includes a connecting end and a receiving end. The receiving end includes first and second receiving sections. The driving component is adapted to be inserted into the connecting component. The driving component includes first and second engaging sections. The first engaging section is tightly fit in the first receiving section such that the first engaging section includes an outer periphery including a flange that is formed after the first engaging section is forced into the first receiving section, and is extended radially outwards to abut against the first receiving section. The second engaging section is fit in the second receiving section. The second engaging section has a shape corresponding to the second receiving section.

13 Claims, 6 Drawing Sheets

INSERT BIT

BACKGROUND OF THE INVENTION

1. Field of the Invention

The present invention relates to an insert bit having a strong structure and not easily damaged.

2. Description of the Related Art

A conventional insert bit generally defines a connecting end for connecting the inert bit to a tool or a tool handle and a driving end for driving an object to be driven. Generally, the conventional insert bit is a one-piece structure and is made of relatively harder material to withstand wear by the connected tool or tool handle during the operation that the connected tool or tool handle drives the insert bit to drive the object to be driven.

Some conventional insert bits have a relative longer longitudinal length for specific tools or tool handles and are made of two pieces, such as shown in FIG. 7, to save material and cost. FIG. 7 shows a conventional insert bit includes a connecting member 91 and a driving member 92. The driving member 92 is tightly fitted in the connecting member 91. The connecting member 91 includes a hole 911 defined therein. The driving member 92 includes a fitting end 921 tightly received in the hole 911. The hole 911 has a hexagonal cross section. The fitting end 921 of the driving member 92 has a hexagonal cross section. Unfortunately, this conventional insert bit is not strong enough to undergo a relatively large toque imposed when the connected tool or tool handle starts turning it and is also susceptible to breakage when being rotated rapidly.

The present invention is, therefore, intended to obviate or at least alleviate the problems encountered in the prior art.

SUMMARY OF THE INVENTION

According to the present invention, an insert bit includes a connecting component and a driving component. The connecting component includes a connecting end and a receiving end. The insert bit is adapted to be connected with a pneumatic tool or an electric tool by the connecting end. The receiving end includes an inner periphery delimiting first and second receiving sections. The second receiving section is extended from the first receiving section. Moreover, the receiving end includes an open end defined at a distal end of the first receiving section and a closed end defined at a distal end of the second receiving section, respectively. The driving component is adapted to be inserted into the connecting component. The driving component includes first and second engaging sections and a driving end. The second engaging section is defined between the first engaging section and the driving end. The first engaging section is tightly fit in the first receiving section such that the first engaging section includes an outer periphery including a flange that is formed after the first engaging section is forced into the first receiving section, and is extended radially outwards to abut against the first receiving section. The second engaging section is fit in the second receiving section. The second engaging section includes an outer periphery having a shape corresponding to the second receiving section. The insert bit is adapted to drive an object by the driving end.

It is an object of the present invention to provide an insert bit having a strong structure.

It is another object of the present invention to provide an insert bit having a relative longer longitudinal length for specific tools or tool handles and made of two pieces.

Other objects, advantages, and new features of the present invention will become apparent from the following detailed description of the invention when considered in conjunction with the accompanied drawings.

DETAILED DESCRIPTION OF THE PREFERRED EMBODIMENT

Figure 1:
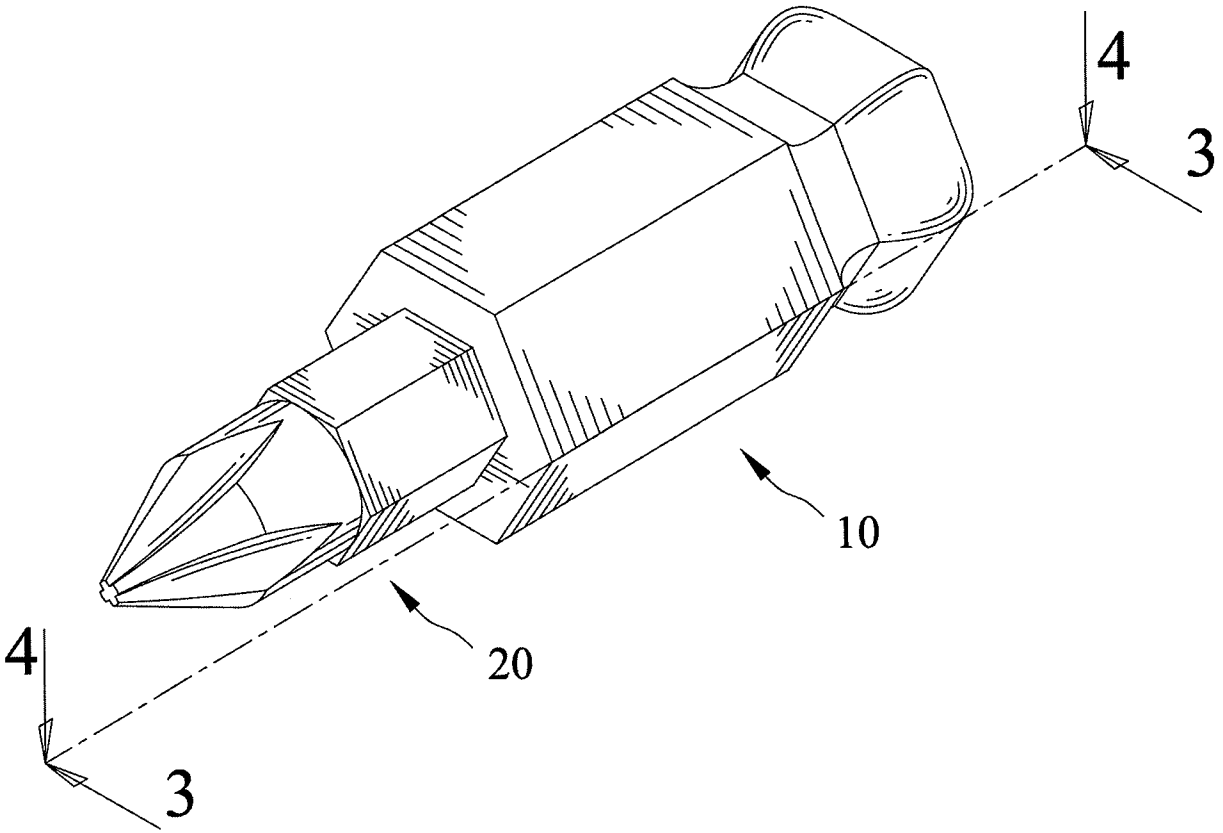
FIG. 1 is a perspective view of an insert bit in accordance with the present invention.
Figure 2:
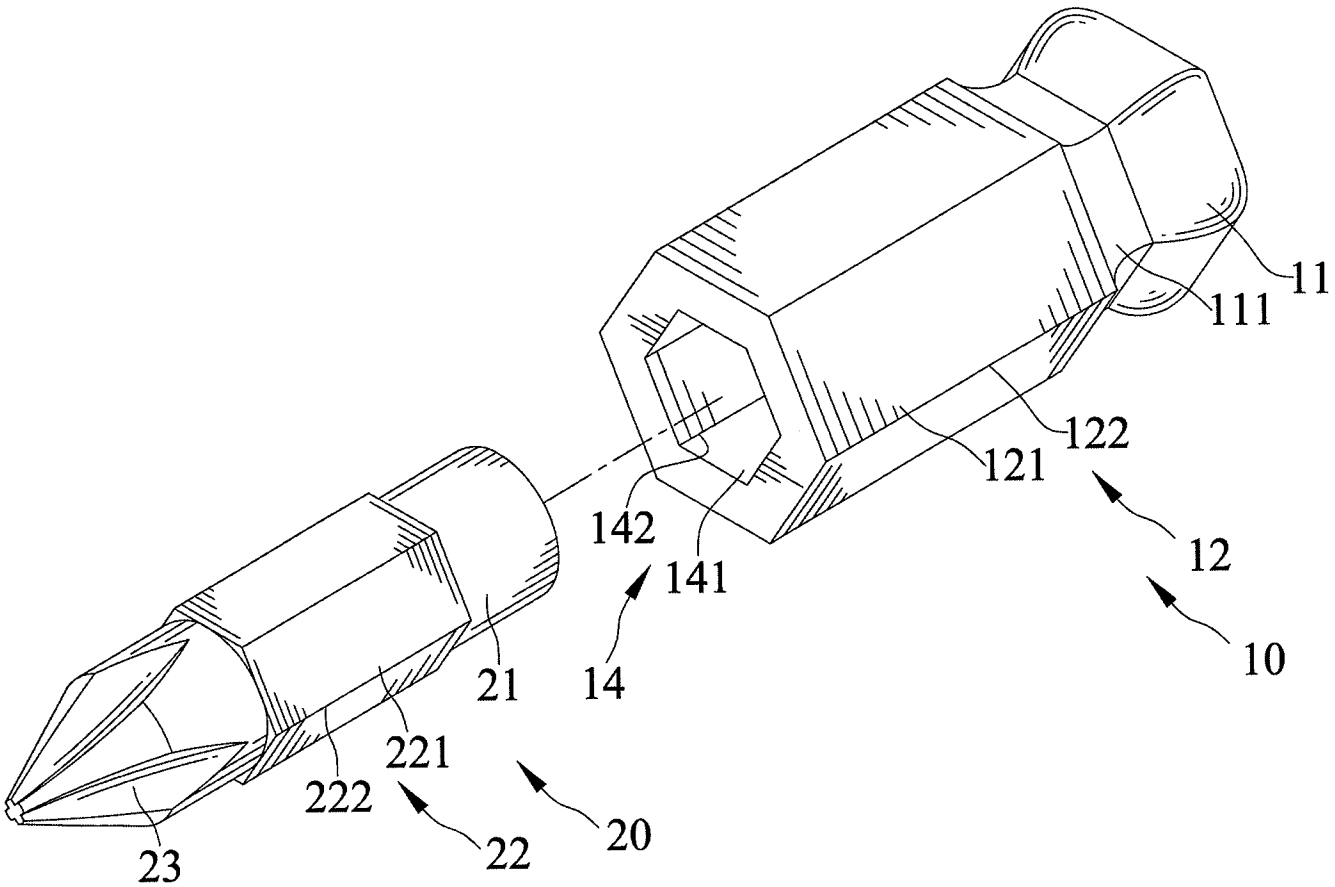
FIG. 2 is an exploded perspective view of the insert bit shown in FIG. 1.
Figure 3:
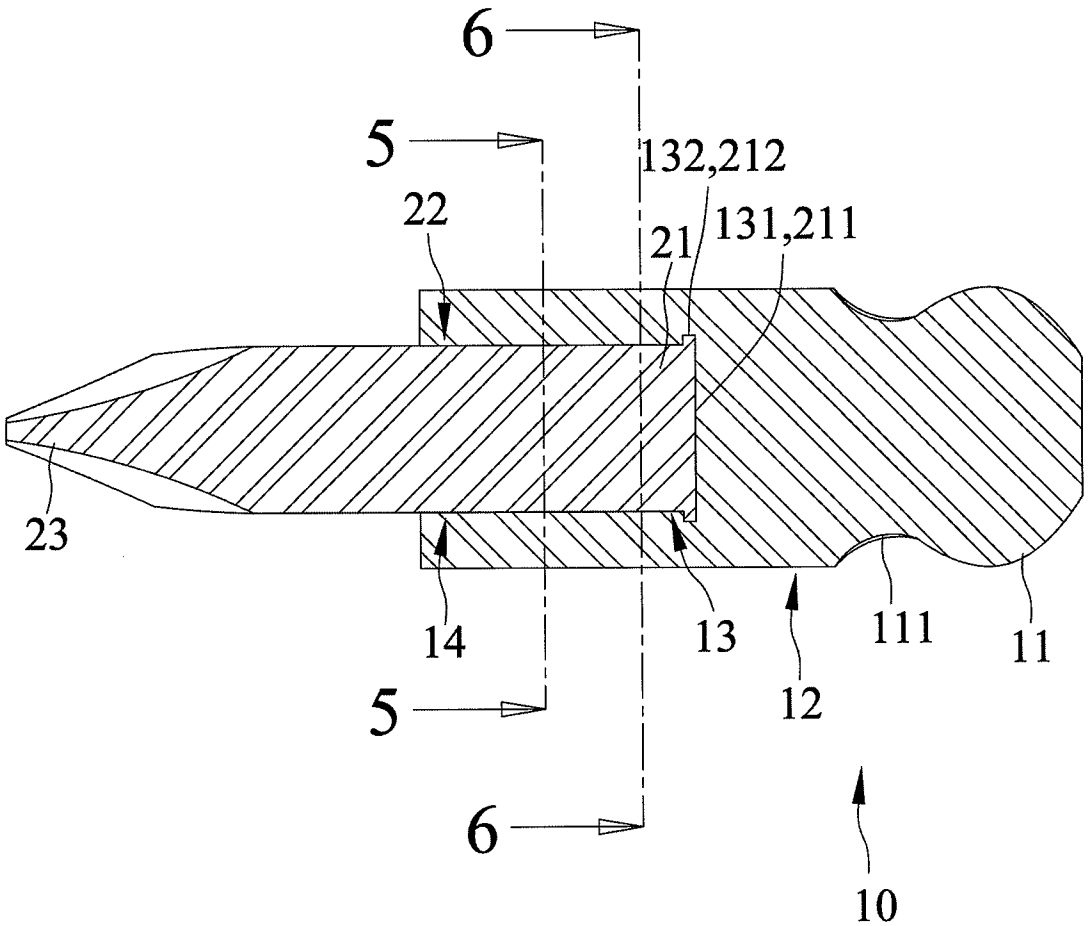
FIG. 3 is a cross-sectional view taken along line 3-3 of FIG. 1.
Figure 4:
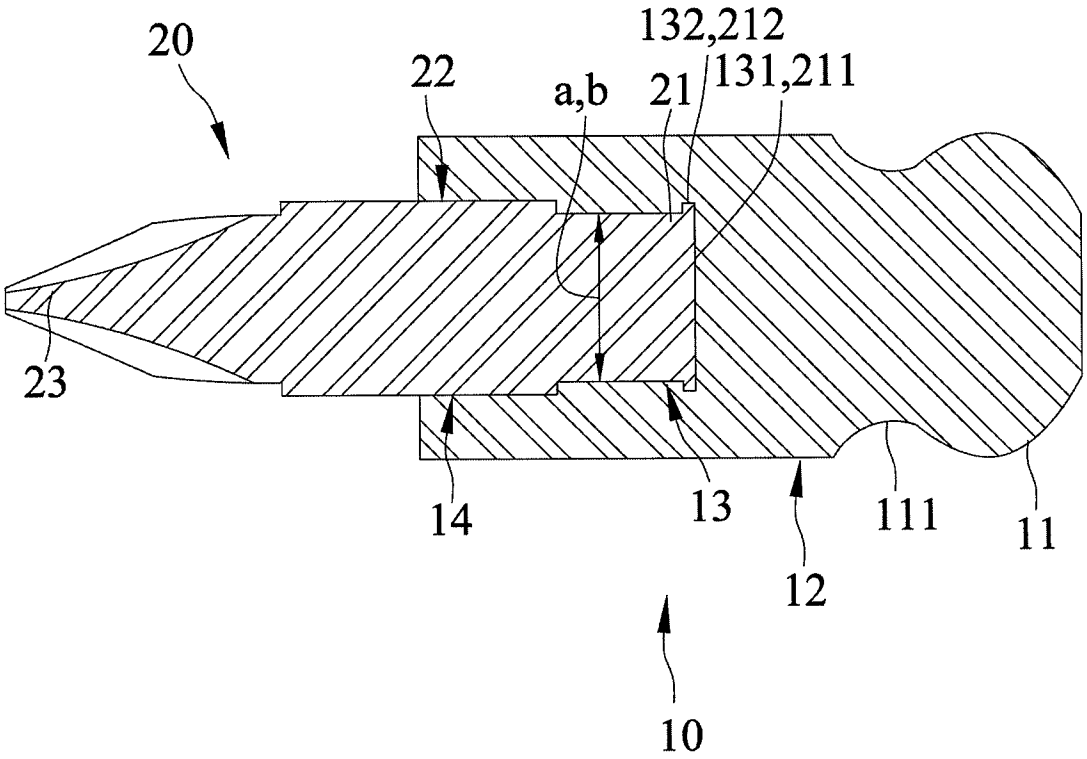
FIG. 4 is a cross-sectional view taken along line 4-4 of FIG. 1.
Figure 6:
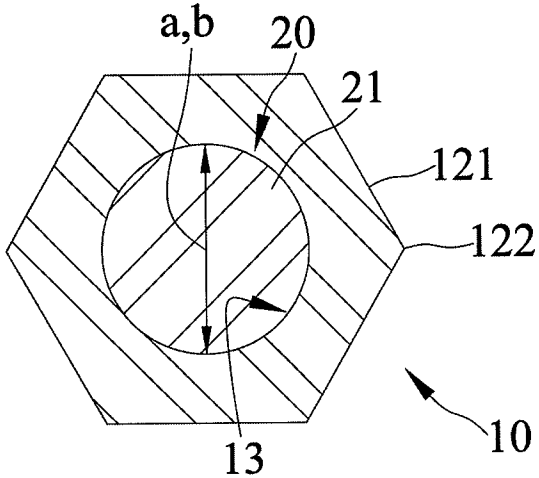
FIG. 6 is a cross-sectional view taken along line 6-6 of FIG. 3.
Figure 5:
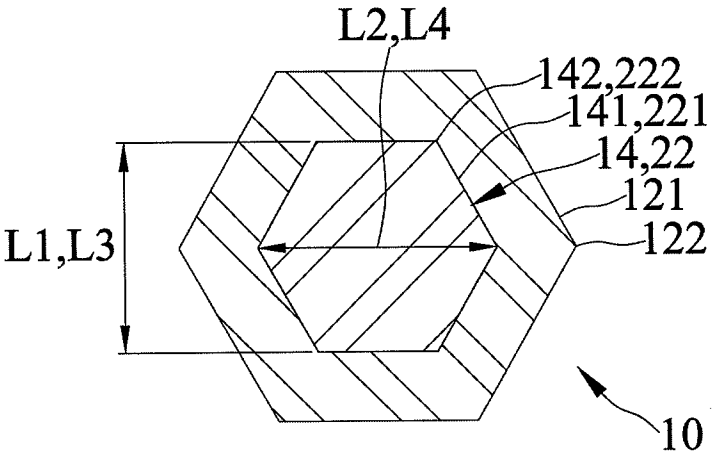
FIG. 5 is a cross-sectional view taken along line 5-5 of FIG. 3.
Figure 7:
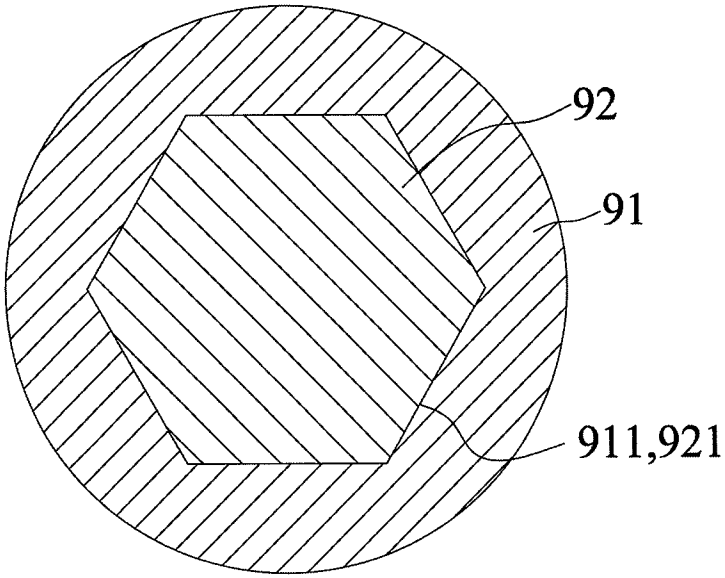
FIG. 7 PRIOR ART
FIG. 7 is a cross-sectional view of a conventional insert bit.

Referring to FIGS. 1 through 6, an insert bit includes a connecting component 10 and a driving component 20.

The connecting component 10 includes a connecting end 11 and a receiving end 12. The insert bit is adapted to be connected with a pneumatic tool or an electric tool by the connecting end 11. The connecting end 11 has a first body of a shape that is substantially spherical and a second body of a shape that includes two enlarged distal ends and a narrowed middle. The second body defines a neck 111 and includes one of the two distal ends connected with the first body and the other distal end connected with the receiving end 12, respectively. The receiving end 12 includes an inner periphery delimiting first and second receiving sections 13 and 14. The second receiving section 14 is extended from the first receiving section 13. Moreover, the receiving end 12 includes an open end defined at a distal end of the second receiving section 14 and a closed end defined at a distal end of the first receiving section 13, respectively. The receiving end 12 has a shape including a plurality of first flat faces 121, and the two adjacent first flat faces 121 defining a first included angle 122. The receiving end 12 has a polygonal cross section. The second receiving section 14 has a shape including a plurality of second flat faces 141, and the two adjacent second flat faces 141 defining a second included angle 142. Two of the plurality of second flat faces 141 are opposite to each other and spaced at a first perpendicular distance L1. Also, a first length L2 is defined between two diametrically spaced corners of the plurality of second flat faces 141. The first length L2 is greater than the first perpendicular distance L1. Each of the plurality of first flat faces 121 is disposed correspondingly to each of the plurality of second flat faces 141. Each of the plurality of first included angles 122 is disposed correspondingly to each of the plurality of second included angles 142. Each of the plurality of second flat faces 141 and each of the plurality of first flat faces 121 that disposed correspondingly are spaced at a perpendicular distance, with a plurality of perpendicular distances defined between the plurality of second flat faces 141 and the plurality of first flat faces 121 all being equal. Further, a slot 132 is extended radially outwardly from the first receiving section 13 and is defined at the distal end thereof.

The driving component 20 is adapted to be inserted into the connecting component 10. The driving component 20 includes first and second engaging sections 21 and 22 and a driving end 23. The first and second engaging sections 21 and 22 have different cross sections. The first engaging section 21 has a circular cross section and the second engaging section 22 has a polygonal cross section, respectively. The second engaging section 22 is defined between the first engaging section 21 and the driving end 23. The first engaging section 21 is tightly fit in the first receiving section 13 such that the first engaging section 21 includes an outer periphery including a flange 212 that is formed after the first engaging section 21 is forced into the first receiving section 13, and is extended radially outwards to abut against the first receiving section 13. The flange 212 is defined at the distal end of the first engaging section 21. A periphery of the first receiving section 13 and a periphery of the first engaging section 21 are abutted against each other. The periphery of the first receiving section 13 defines a first diametrical length a and the periphery of the first engaging section 21 defines a second diametrical length b equaling the first diametrical length a. Additionally, the first perpendicular distance L1 is equal to the first diametrical length a. The second engaging section 22 is fit in the second receiving section 14. The second engaging section 22 includes an outer periphery having a shape corresponding to the second receiving section 14. The second engaging section 22 has a shape including a plurality of third flat faces 221, and the two adjacent third flat faces defining a third included angle 222. Two of the plurality of third flat faces 221 are opposite to each other and spaced at a second perpendicular distance L3. Also, a second angle L4 is defined between two diametrically spaced corners of the plurality of third flat faces 221. The second angle L4 is greater than the second perpendicular distance L3. Additionally, the second perpendicular distance L3 is equal to the second diametrical length b. Each of the plurality of third flat faces 221 and each of the plurality of first flat faces 121 are disposed correspondingly to each other and spaced at a perpendicular distance, with a plurality of perpendicular distances defined between the plurality of third flat faces 221 and the plurality of first flat 121 faces all being equal. Furthermore, the closed end of the receiving end 12 forms a bottom surface 131 and a distal end of the first engaging section 21 defines an end surface 211 abutted against the bottom surface 131. Additionally, the flange 212 has a portion abutted against the bottom surface 131. The slot 132 includes the flange 212 engaged and limited therein. Since the flange 212 is limited in the slot 132, the first engaging section 21 is unable to be moved out of the first receiving section 13. Therefore, the driving component 20 is prevented from moved out of the connecting component 10. The insert bit is adapted to drive an object by the driving end 23.

In view of the forgoing, the insert bit has a strong structure and a relative longer longitudinal length for specific tools or tool handles and made of two pieces.

While the specific embodiment has been illustrated and described, numerous modifications come to mind without significantly departing from the spirit of invention, and the scope of invention is only limited by the scope of accompanying claims.

What is claimed is:

1. An A insert bit comprising: a connecting component including a connecting end and a receiving end, with the insert bit adapted to be connected with a pneumatic tool or an electric tool by the connecting end, with the receiving end including an inner periphery delimiting first and second receiving sections, with the second receiving section extended from the first receiving section, with the receiving end including an open end defined at a distal end of the second receiving section and a closed end defined at a distal end of the first receiving section respectively; and a driving component adapted to be inserted into the connecting component and including first and second engaging sections and a driving end, with the second engaging section defined between the first engaging section and the driving end, with the first engaging section tightly fit in the first receiving section, with the second engaging section tightly fit in the second receiving section, with the first engaging section including an outer periphery having a shape corresponding to a shape of and abutting against an inner periphery the first receiving section, with the second engaging section including an outer periphery having a shape corresponding to a shape of and abutting against an inner periphery of the second receiving section, and with the insert bit adapted to drive an object by the driving end;

a slot extended radially outwardly from the first receiving section, wherein the slot is defined at a distal end of the first receiving section of the receiving end, and wherein the first engaging section of the driving component includes a flange extending radially outwardly and engaged and limited in the slot;

wherein the driving component is tightly fit in and prevented from moving out of the connecting component.

2. The insert bit as claimed in claim 1, wherein the receiving end has a shape including a plurality of first flat faces, and the two adjacent first flat faces defining a first included angle, wherein the receiving end has a polygonal cross section, wherein the second receiving section has a shape including a plurality of second flat faces, with the two adjacent second flat faces defining a second included angle, wherein each of the plurality of first flat face is disposed correspondingly to each of the plurality of second flat face, and each of the plurality of first included angle is disposed correspondingly to each of the plurality of second included angle, wherein each of the plurality of second flat faces and each of the plurality of first flat faces that disposed correspondingly are spaced at a perpendicular distance, with a plurality of perpendicular distances defined between the plurality of second flat faces and the plurality of first flat faces all being equal, wherein the second engaging section has a shape including a plurality of third flat faces, and the two adjacent third flat faces defining a third included angle, wherein each of the plurality of third flat faces and each of the plurality of first flat faces are disposed correspondingly to each other and spaced at a perpendicular distance, with a plurality of perpendicular distances defined between the plurality of third flat faces and the plurality of first flat faces all being equal.

3. The insert bit as claimed in claim 2, wherein a periphery of the first receiving section and a periphery of the first engaging section are abutted against each other, with the periphery of the first receiving section defining a first diametrical length and the periphery of the first engaging section defining a second diametrical length equaling the first diametrical length.

4. The insert bit as claimed in claim 3, wherein two of the plurality of second flat faces are opposite to each other and spaced at a first perpendicular distance, wherein a first length is defined between two diametrically spaced corners of the plurality of second flat faces, with the first length greater than the first perpendicular distance.

5. The insert bit as claimed in claim 4, wherein two of the plurality of third flat faces are opposite to each other and spaced at a second perpendicular distance, wherein a second length is defined between two diametrically spaced corners of the plurality of third flat faces, with the second length greater than the second perpendicular distance.

6. The insert bit as claimed in claim 5, wherein the first perpendicular distance is equal to the first diametrical length and the second perpendicular distance is equal to the second diametrical length.

7. The insert bit as claimed in claim 1, wherein the first and second engaging sections have different cross sections.

8. The insert bit as claimed in claim 7, wherein the first engaging section has a circular cross section and the second engaging section has a polygonal cross section respectively.

9. The insert bit as claimed in claim 7, wherein the receiving end has a shape including a plurality of first flat faces, and the two adjacent first flat faces defining a first included angle, wherein the receiving end has a polygonal cross section, wherein the second receiving section has a shape including a plurality of second flat faces, with the two adjacent second flat faces defining a second included angle, wherein each of the plurality of first flat face is disposed correspondingly to each of the plurality of second flat face, and each of the plurality of first included angle is disposed correspondingly to each of the plurality of second included angle, wherein each of the plurality of second flat faces and each of the plurality of first flat faces that disposed correspondingly are spaced at a perpendicular distance, with a plurality of perpendicular distances defined between the plurality of second flat faces and the plurality of first flat faces all being equal, wherein the second engaging section has a shape including a plurality of third flat faces, and the two adjacent third flat faces defining a third included angle, wherein each of the plurality of third flat faces and each of the plurality of first flat faces are disposed correspondingly to each other and spaced at a perpendicular distance, with a plurality of perpendicular distances defined between the plurality of third flat faces and the plurality of first flat faces all being equal.

10. The insert bit as claimed in claim 9, wherein a periphery of the first receiving section and a periphery of the first engaging section are abutted against each other, with the periphery of the first receiving section defining a first diametrical length and the periphery of the first engaging section defining a second diametrical length equaling the first diametrical length.

11. The insert bit as claimed in claim 10, wherein two of the plurality of second flat faces are opposite to each other and spaced at a first perpendicular distance, wherein a first length is defined between two diametrically spaced corners of the plurality of second flat faces, with the first length greater than the first perpendicular distance.

12. The insert bit as claimed in claim 11, wherein two of the plurality of third flat faces are opposite to each other and spaced at a second perpendicular distance, wherein a second length is defined between two diametrically spaced corners of the plurality of third flat faces, with the second length greater than the second perpendicular distance.

13. The insert bit as claimed in claim 12, wherein the first perpendicular distance is equal to the first diametrical length and the second perpendicular distance is equal to the second diametrical length.

* * * * *